US008192183B2

(12) United States Patent
Jung

(10) Patent No.: US 8,192,183 B2
(45) Date of Patent: Jun. 5, 2012

(54) PRISMATIC PUMP, ESPECIALLY SLURRY PUMP

(76) Inventor: Herbert Jung, Kirchhaslach (DE)

( * ) Notice: Subject to any disclaimer, the term of this patent is extended or adjusted under 35 U.S.C. 154(b) by 879 days.

(21) Appl. No.: 11/666,785

(22) PCT Filed: Oct. 29, 2005

(86) PCT No.: PCT/EP2005/011611

§ 371 (c)(1),
(2), (4) Date: Apr. 28, 2008

(87) PCT Pub. No.: WO2006/048212

PCT Pub. Date: May 11, 2006

(65) Prior Publication Data

US 2008/0274000 A1 Nov. 6, 2008

(30) Foreign Application Priority Data

Oct. 29, 2004 (DE) ..... 10 2004 052 928

(51) Int. Cl.
*F01C 1/02* (2006.01)
*F04C 2/00* (2006.01)
*F04C 18/00* (2006.01)

(52) U.S. Cl. ..... 418/61.2; 418/5; 418/7; 418/113; 418/119

(58) Field of Classification Search ..... 418/61.2, 418/5, 7, 113, 114, 117, 119; 123/200, 218
See application file for complete search history.

(56) References Cited

U.S. PATENT DOCUMENTS

| | | | | | |
|---|---|---|---|---|---|
| 3,112,868 | A | * | 12/1963 | Hagen | 418/119 |
| 3,186,384 | A | * | 6/1965 | Fuhrmann | 418/117 |
| 3,194,488 | A | * | 7/1965 | Fuhrmann | 418/113 |
| 3,213,714 | A | | 10/1965 | Hejj et al. | |
| 3,249,094 | A | | 5/1966 | Hoppner et al. | |
| 3,869,259 | A | * | 3/1975 | Lindsey | 418/178 |
| 3,875,905 | A | | 4/1975 | Duquette et al. | |
| 3,883,273 | A | * | 5/1975 | King | 418/61.2 |
| 3,890,069 | A | * | 6/1975 | Telang et al. | 418/61.2 |
| 3,922,121 | A | | 11/1975 | Garfinkle et al. | |
| 4,551,073 | A | | 11/1985 | Schwab et al. | |
| 5,888,053 | A | * | 3/1999 | Kobayashi et al. | 417/244 |

FOREIGN PATENT DOCUMENTS

EP 0799996 A 10/1997

* cited by examiner

*Primary Examiner* — Mary A Davis
(74) *Attorney, Agent, or Firm* — Knobbe Martens Olson & Bear LLP

(57) ABSTRACT

The aim of the invention is to provide a simple, smoothly running pump, especially a slurry pump, preferably for concrete, which comprises a driven rotor (4) rotating inside a housing (2). According to the invention, the rotor (4) is configured as a polygonal, prismatic body wherein at least the connecting lines of the corners of the base form an equilateral polygon. The rotor performs a rotational movement about its center axis on an orbit, the longitudinal edges of the prismatic body (4') touching the longitudinal inner wall surface (2') of the housing (2).

20 Claims, 8 Drawing Sheets

PRISMATIC PUMP, ESPECIALLY SLURRY PUMP

The invention relates to a pump, in particular a slurry pump, comprising a rotor driven so as to rotate in a case.

For pumping slurry with the large-grain, abrasive fractions contained therein, such as concrete, piston pumps with two delivery cylinders have conventionally so far been used in which delivery pistons moved by hydraulic cylinders alternately execute suction and pressure strokes, there being an interruption in delivery, which is dependent on the changeover time and on the filling level of the delivery cylinders, each time there is a change from suction to pressure stroke.

Different types of slide valve are used for alternate connection of the delivery cylinders to a supply container or to the delivery pipe, the slide valves also being moved by the hydraulic cylinders. With this type of pump coordination of the pumping process requires a comparatively high level of controller complexity. The inconstant movement of the hydraulic cylinders, and, as a result, the pump elements driven therewith, inevitably results in inconstant delivery of the material to be conveyed that is interrupted which each change from suction to pressure stroke. The inconstancy also results in constantly alternating intermittent acceleration and deceleration of the moved pump elements and the pumped material to be conveyed, which proceeds according to the pump cycle. Consequently all components included and connected in the pump train are subject to cyclically intermittent loading.

At construction sites concrete is usually pumped via what are known as concrete distributor masts, which are assembled so as to be stationary or on bogie wagons that are suitable for road traffic, to the charging point. At this location the described pump characteristics bring about upward swinging of the distributor mast from which, at then end thereof, i.e. at the concrete outlet, movements are produced, the extent of which, as the mast length increases, can endanger the people working in this region and render introduction of the concrete extremely difficult or even make it impossible. An increasingly elevated energy consumption for driving results due to the accelerations, proceeding according to the pump cycle primarily from the mass of the material to be conveyed.

Various devices have become known which reduce the described drawbacks of the piston pumps. However, these are always associated with considerable additional expenditure and also increase the risk of malfunctions.

A further type of pump, which is used for conveying slurries of this kind, such as concrete, is what is known as the hose pump. It is distinguished by a simple, rotatory continuous drive. The construction results in significantly less discontinuity for the hose pump during delivery than in the case of the previously described piston pump. However, its use is restricted to comparatively low delivery pressures (up to 30 bar), and this severely limits its use in pumping of slurries.

The object underlying the invention is to produce a new positive-displacement pump, in particular for use as a slurry pump, for pumping non-homogenous, abrasive media, such as concrete, with which, with a simple construction, the disadvantageous properties of the above-described pump designs may be eliminated or largely avoided and with which additional advantages for its use result.

The rotor, constructed as a prismatic body and in which at least the connecting lines of the corners of the base surfaces form an equilateral polygon, when it is rotated about its centre axis that is simultaneously moved on a circular path, produces with its longitudinal edges the longitudinal inner wall surface of the case.

If a rigid longitudinal case wall is assumed, the rotor, while the centre axis thereof moves through a complete circle, is rotated about the central angle of the equilateral polygon formed by the connecting lines of the corners of the base surfaces of the prismatic body. From this it follows that the shape of the longitudinal inner wall surface of the case is determined by the number of longitudinal edges of the prismatic body.

The constant contact of the longitudinal edges of the prismatic body with the longitudinal inner wall surface of the case means that constantly changing spaces are formed in the process by the longitudinal inner wall surface of the case and the longitudinal outer wall surfaces of the prismatic body, in connection with the inner wall surfaces of the two end walls of the case, in which spaces the media to be pumped, in particular slurries, such as concrete, are conveyed.

The circular movement of the centre axis of the rotor is produced by the mounting thereof on the eccentric of the driven eccentric shaft mounted in the end walls of the case. The rotation of the rotor about its centre axis in accordance with the described regularity can be forced using various gearings.

Two gearings are to be described by way of example here:

The first gearing is formed by a hollow toothed wheel, arranged on the centre axis of the rotor so as to be rotor-secured, which meshes with a pinion arranged on the axis of the eccentric shaft and secured to an end wall of the case. The measure of the eccentricity is fixed in this gearing by the described gear and its regularity.

The second gearing consists of a planetary gearing arranged on the centre axis of the rotor and of which the sun wheel is fastened to the eccentric of the eccentric shaft so as to be secured against rotation, of which the planetary wheels are mounted on the rotor-secured planet carrier so as to be rotation-free, of which the internal gear is mounted on the eccentric of the eccentric shaft so as to be rotation-free and is supported by a cross coupler on an end wall of the case so as to be secured against rotation. Support of the internal gear on the case via the cross coupler means that the internal gear now only executes a movement called a "circular translation." The gearing thus corresponds to a planetary gearing with drive via a sun wheel, take-off via planet carriers, and internal gear secured to the case. The measure for the eccentricity can, as far as the principle is concerned, be freely selected in this gearing.

No valves are required for controlling the supply and discharge of the material to be conveyed. Alternately provided on the longitudinal wall of the case are at least one respective opening for supplying the material to be conveyed and one opening for discharging the material to be conveyed. In the process it must be provided that arranged on the longitudinal inner wall surface of the case are in each case the end of a supply opening and the start of a discharge opening and the end of a discharge opening and the start of a supply opening offset in relation to the respective centre of the rotor by the central angle of the equilateral polygon formed by the connecting lines of the corners of the base surfaces of the prismatic body. (See, e.g., the end 20 of supply opening Z, the start 22 of a discharge opening A, the end 24 of discharge opening A, and the start 24 of supply opening Z illustrated in FIG. 1). By maintaining the above regularity for the arrangement of the supply and discharge openings with respect to each other, their position on the longitudinal inner wall surface of the case can, as far as the principle is concerned, be freely selected.

The position of the supply and discharge openings, in conjunction with the length of the prismatic body, determines the geometric delivery volume of the pump. To obtain the largest possible delivery flow it is therefore necessary to fix the position of the supply and discharge openings such that the value for the geometric delivery volume is a maximum.

If the direction of rotation of the rotor is reversed, the direction of the delivery flow is reversed. This also provides the possibility of recirculation. If a pentagonal prism is selected for the rotor, two supply and discharge openings may be alternately provided on the longitudinal case wall. This then produces two pump cycles accordingly with complete rotation of the rotor.

As the number of corners for the prismatic body of the rotor increases, the number of possible supply and discharge openings, and accordingly, the number of pump cycles with complete rotation of the rotor also increases according to a specific regularity. The pulsation of the delivery flow decreases as the number of pump cycles that exists with complete rotation of the rotor increases.

Owing to the above fact use of this pump principle is also attractive for pumping homogenous liquids in further fields of application, such as in the chemical industry. Use in the hydrostatics of hydraulic pumps and hydraulic motors is also expedient.

When applying the pump principle to positive-displacement pumps, which are provided for pumping slurries with large-grain, abrasive fractions contained therein, for example concrete, to attain the greatest possible geometric delivery volume with the smallest possible dimensions it is appropriate to provide a triangular or rectangular prism for the rotor. Only one pump cycle is possible in this case with complete rotation of the rotor owing to the regularity for the arrangement of the supply and discharge openings.

An uninterrupted delivery flow with only slight accelerations and decelerations for the material to be conveyed is achieved here by the arrangement of at least two pump units parallel and side-by-side and which are coupled via their eccentric shafts so as to be offset by a specific angular measurement.

A charging container can be particular when configured as a being arranged such that the built on the slurry pump, in concrete pump, the slurry pump supply opening(s) thereof are located in the charging container below the lowest level of the poured-in material to be conveyed.

In the rotor, preferably on the centre axis thereof, there is arranged a, preferably cylindrical, partition wall which radially surrounds the described gearing and extends to the inner wall surfaces of the two end walls of the case. It is advantageous in this case to determine the radial position of the partition wall, in connection with fixing of the rotor dimensions, such that the surfaces brushed over by the end faces of the partition wall are located outside of the surfaces brushed over by the end faces of the outer walls of the rotor forming the longitudinal outer wall surfaces of the prismatic body.

The space which is formed by the longitudinal inner wall surfaces of the outer walls of the prismatic body and the longitudinal outer wall surfaces of the partition wall in connection with the inner wall surfaces of the two end walls of the case is provided as a flushing chamber. The flushing liquid can be supplied and discharged either via the end walls of the case or else via conduits leading through the eccentric shaft and rotor.

Provided on the rotor on the end faces of the outer walls forming the longitudinal outer wall surfaces of the prismatic body are elastic elements with high wear resistance and which touch the inner wall surfaces of the two end walls of the case. Consequently the entire interior, which is formed by the longitudinal inner wall surfaces of the outer walls of the prismatic body in connection with the inner wall surfaces of the two end walls of the case, is sealed against the constantly changing delivery chambers.

The elastic elements are preferably vulcanised on or glued on. For the strength of the connection between the elastic elements and the surfaces of the metal walls it is advantageous if the size of the connecting surfaces is increased in that the elastic elements extend beyond the ends faces on the longitudinal outer wall surfaces of the outer walls of the prismatic body. High wear resistance of the longitudinal outer wall surfaces of the metal outer walls also becomes superfluous thereby. With an embodiment of this kind there results the possibility of improved shaping of the elastic elements that is matched to the overall function.

At the rotor, on the longitudinal edges of the prismatic body, sealing strips separate the delivery chambers from each other, or seal them from each other, by their constant contact with the longitudinal inner wall surface of the case. The sealing strips are preferably replaceably held on the longitudinal edges of the prismatic body. They are manufactured from highly wear-resistant and hard material since with their end faces they also pass over the supply and discharge openings on the longitudinal inner wall surface of the case and penetrate the medium to be pumped in the process.

The sealing strips can in particular be received and held in a groove worked into the longitudinal edges of the prismatic body. For this purpose recesses alternately worked-in and filled with vulcanised-on or glued-on elastic material may be provided on the longitudinal edges of the prismatic body, so when they are loaded by the pressure of the medium to be pumped the sealing strips held in the worked-in grooves are pressed against the longitudinal inner wall surface of the case as a function of pressure.

Provided on the rotor and at the end faces of the preferably cylindrical partition wall are sealing elements and in particular also guide elements which touch the inner wall surfaces of the two end walls of the case. As a result the space radially surrounded by the inner wall surface of the partition wall and formed in connection with the inner wall surfaces of the two end walls of the case is sealed from the space used as a flushing chamber.

The sides of the sealing elements facing the sealed spaces are expediently equipped with a very good stripping effect, so fine-grain and abrasive particles adhering to the inner wall surfaces of the end walls of the case are reliably stripped. On the rotor the longitudinal outer walls of the prismatic body are formed by a plurality of preferably identical individual elements which are releasably fastened to a base body which is assembled from the remaining rotor elements. It is advantageous for the arrangement of the provided sealing elements to assemble the outer walls from angular elements.

In a further embodiment for the rotor the longitudinal outer walls of the prismatic body are formed by an undivided element which is releasably fastened to a base body which is assembled from the remaining rotor elements. With the one-part embodiment of the longitudinal outer walls of the prismatic body there are no separation points which complicate sealing between the delivery chambers and the interior of the rotor. The one-part element also results in simpler assembly of the rotor.

On the pump case the inner wall surface of the longitudinal case wall is wear-resistant and/or equipped with a wear-resistant coating, so the abrasion during delivery of abrasive material, such as concrete, is kept as low as possible. Provided on the inner sides of the two end walls of the case, at least in the region of the surfaces brushed over by the end-face sealing elements and guide elements of the rotor, are releasably fastened plates. The inner surfaces of the plates are used as counter running surfaces for the sealing elements and guide elements of the rotor and simultaneously form the end-face limitations of the constantly changing delivery chambers and flushing chamber. This produces a very smooth and wear-resistant surface which is preferably produced by a coating, in particular a hard chromium plating. The pump case is formed by a longitudinal wall and two end walls releasably connected thereto.

The above division of the pump case produces a simple construction. The shape of the inner face of the longitudinal case wall results from the path of the longitudinal edges of the prismatic body during its movement according to the described regularity. The supply and discharge openings for the material to be conveyed are arranged in the longitudinal case wall.

The end case walls are preferably screwed to the longitudinal case wall by way of a flanged joint. Arranged in the centre of the end case walls are bearings for the eccentric shaft. On the eccentric shaft the diameter of the eccentric is expediently larger than the largest shaft diameter enlarged by twice the amount for the eccentricity. This type of construction results in simple manufacture for the eccentric shaft as well as simple assembly for the rotor.

The bearings and the gear teeth, as well as the end-face sealing and guide elements, are supplied with lubricants from at least one central lubricating unit to minimise wear. The lubricants are supplied via conduits lead through the eccentric shaft to all lubricating points.

In a preferred embodiment of the pump as a slurry pump the rotor is constructed as a prismatic body in which at least the connecting lines of the corners of the base surfaces form an equilateral triangle. A rotor constructed in this way, compared with rotors with a polygonal prismatic body, results in the greatest possible delivery volume with comparable rotor dimensions, or with a given delivery volume, the smallest comparable rotor dimensions. The diameter of the circumcircle of the base surfaces, formed by the connecting lines of the corners, of the prismatic body can be used as a comparison dimension in this case.

If preferably arc of a circle-shaped bulges are provided on the rotor in the middle region of the longitudinal outer walls of the prismatic body, the space for the gearing arranged in the rotor can be greater than that predetermined by the connecting lines of the corners of the prismatic body. The described bulges also reduce the spatial fraction in the delivery chambers that is ineffective for the delivery volume.

The following advantages result, compared with the prior art, for the above-described pump:

- simple construction without valves (slide valves), no controller for the pumping process, simple, rotatory continuous operation,
- almost complete filling of the deliver chambers,
- uninterrupted delivery flow with comparatively low accelerations for the material to be conveyed, less additional energy used than in piston pumps,
- delivery pressures as with piston pumps,
- compact construction for the pump unit, consequently smaller, more compact installation space.

When used as a concrete pump its construction, together with a distributor mast, on a bogie wagon that is suitable for road traffic, results in improved possibilities for the configuration of the distributor mast substructure and a larger share in the permissible overall weight for the distributor mast as a whole owing to the compact design and low weight of the pump unit.

A plurality of embodiments will be explained and described hereinafter with reference to the drawings, in which.

Figure 7A:
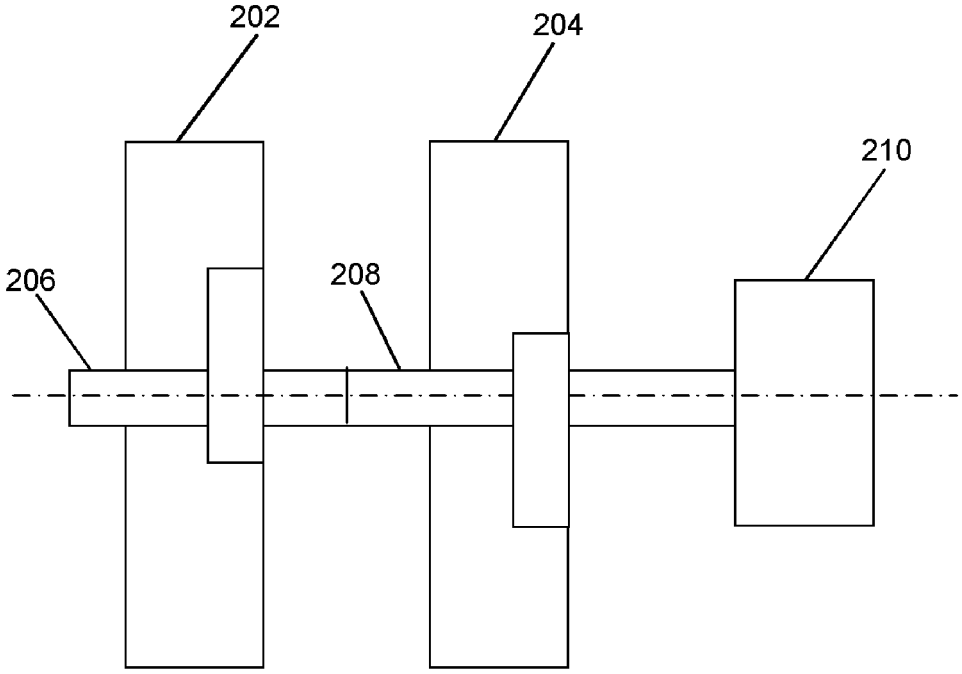

FIG. 7A shows a schematic view of a plurality of pump units 202 and 204 arranged parallel and side-by-side and, coupled to each other by their eccentric shafts 206 and 208, and driven by one or more drive(s) 210 via the free ends of the eccentric shafts.

Figure 7B:
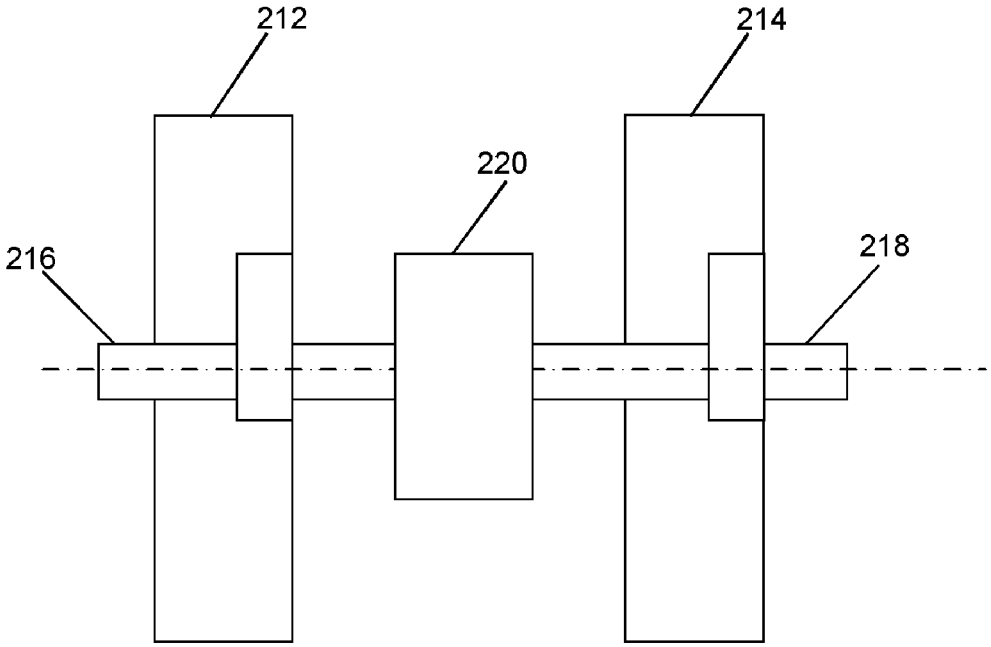

FIG. 7B shows a schematic view of a two pump units 212 and 214 arranged parallel and side-by-side and coupled and driven by a drive 220 arranged between the pump units 212 and 214, via the eccentric shafts 216 and 218.

Figure 1A:
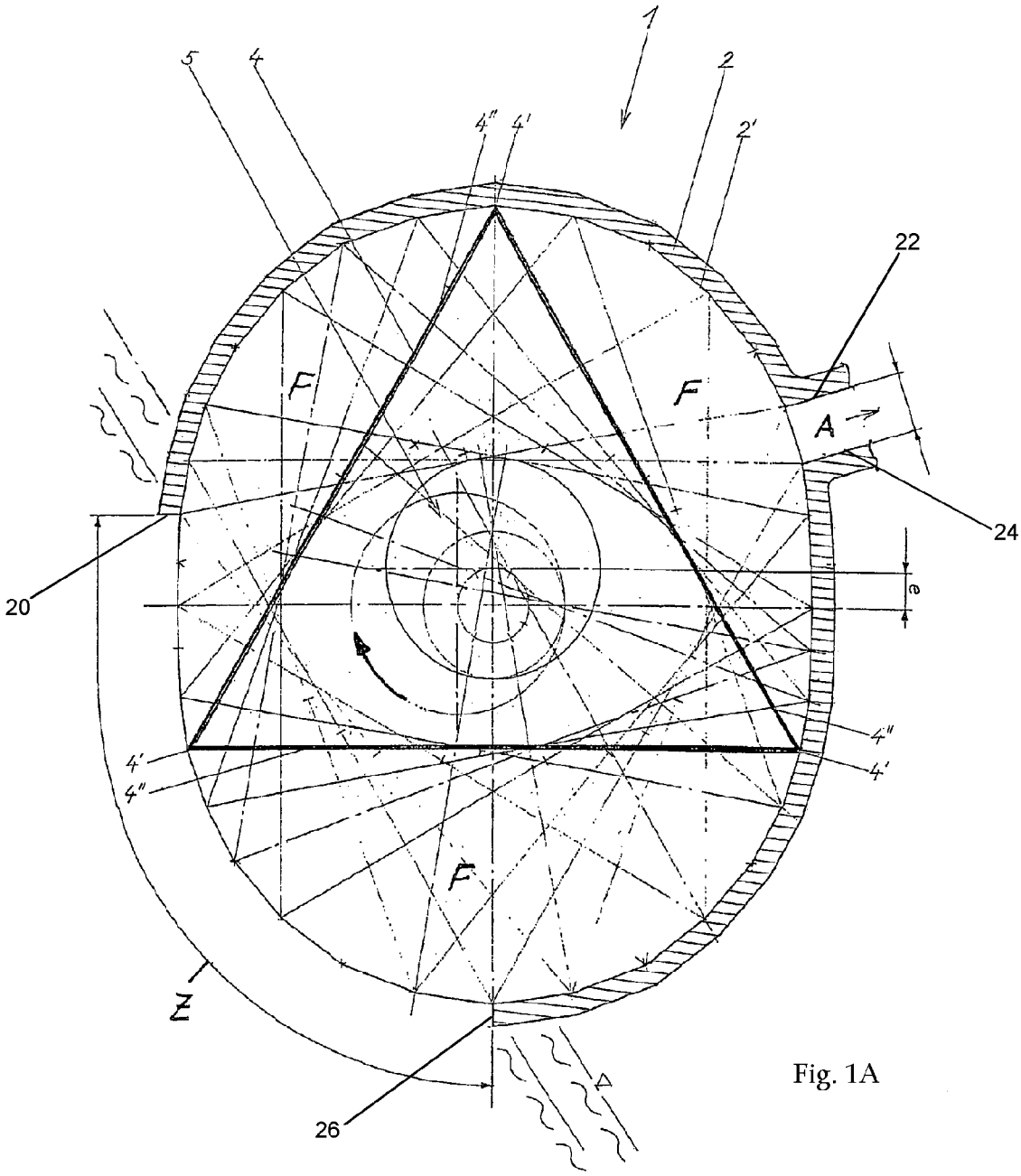
FIGS. 1A-1C shows a slurry pump in cross-section.
Figure 1B:
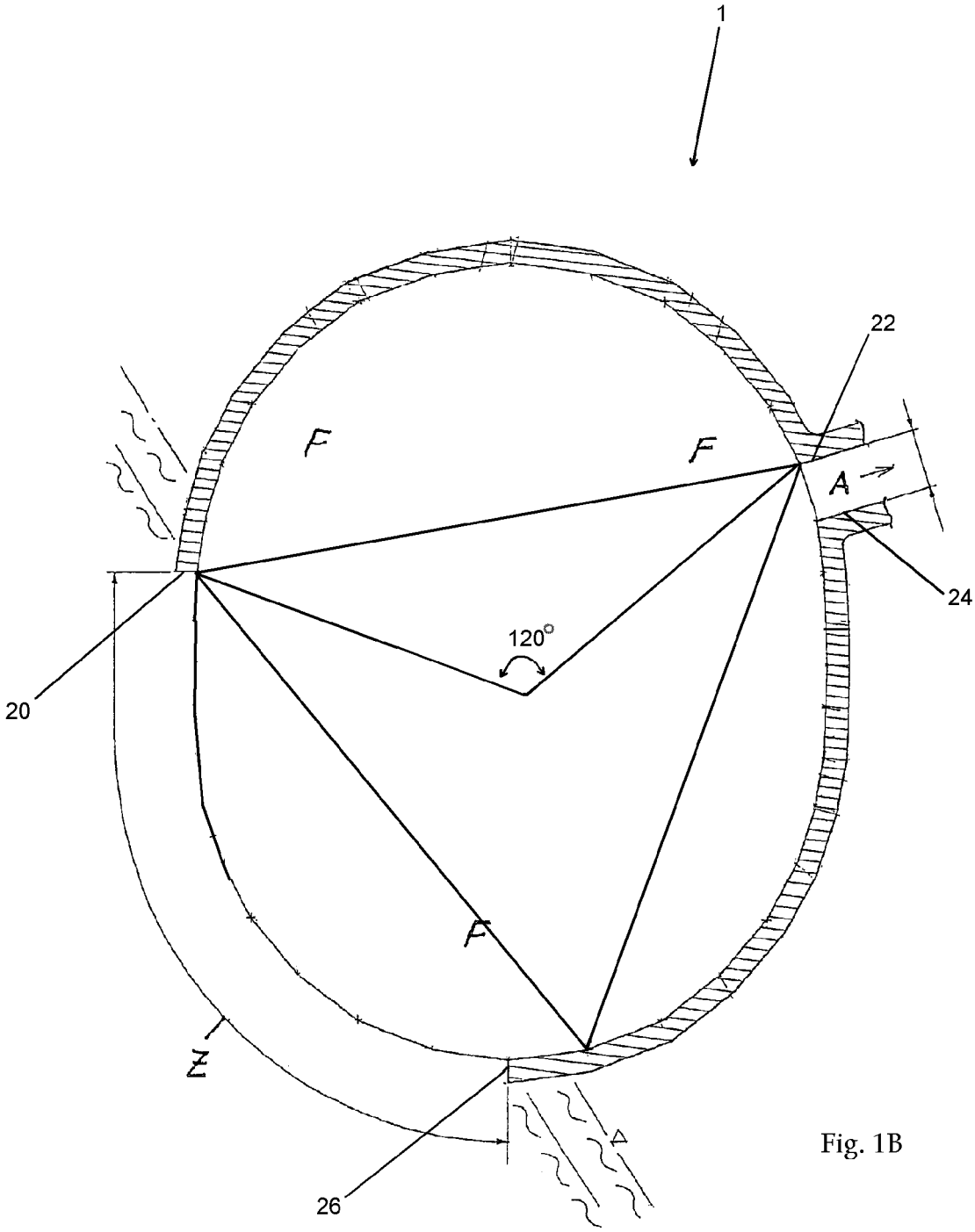
Figure 1C:
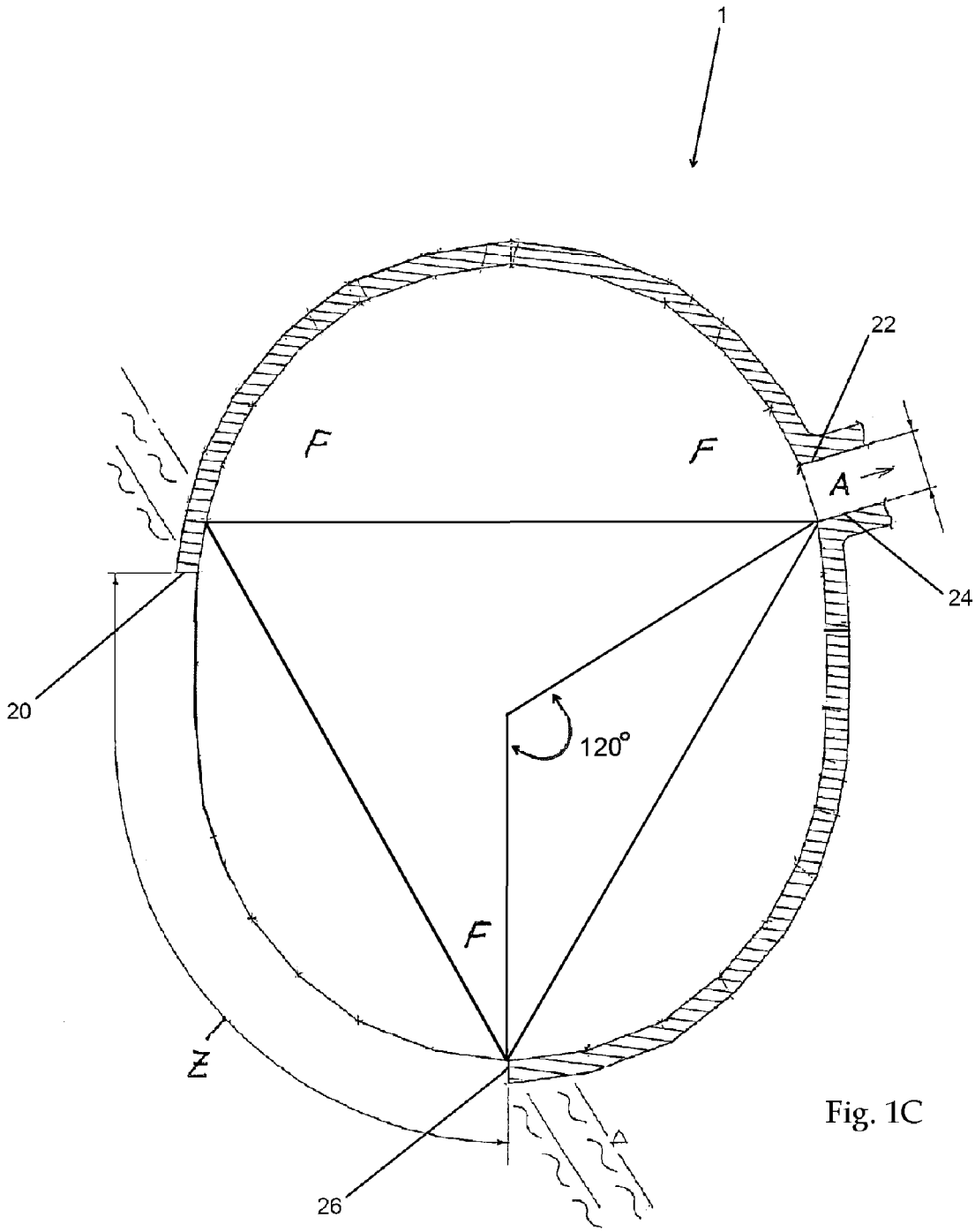

FIG. 1 (consisting of FIGS. 1A-1C) schematically shows a slurry pump 1 with a rotor 4, constructed as a triangular prism (offset in relation to the respective centre of the rotor 4 by the central angle of the equilateral polygon formed by the connecting lines of the corners of the base surfaces of the prismatic body) and the longitudinal wall of the case 2 in cross-section. A plurality of rotor settings are indicated, it being possible to see that the longitudinal edges of the triangular rotor prism 4' constantly touch the longitudinal inner wall surface 2' of the case 2. Delivery chambers (F) that constantly change with the rotor setting are formed by the longitudinal inner wall surface 2' of the housing 2 and the longitudinal outer wall surfaces of the rotor prism 4" in conjunction with the inner wall surfaces of the two end walls of the case 2.

A gearing 5 is arranged in the centre of the rotor 4. The longitudinal wall of the case 2 is interrupted once in each case by an opening for the supply (Z) and an opening for the discharge (A) of the material to be conveyed. Also shown is how the slurry pump 1 in its fitted state is immersed with its supply opening into the medium to be pumped (possibly in a charging container). When the rotor 4 is rotated in the clockwise direction there is delivery from the supply opening to the discharge opening. With rotation in the opposite direction, there is delivery from the discharge opening to the supply opening.

Figure 2:
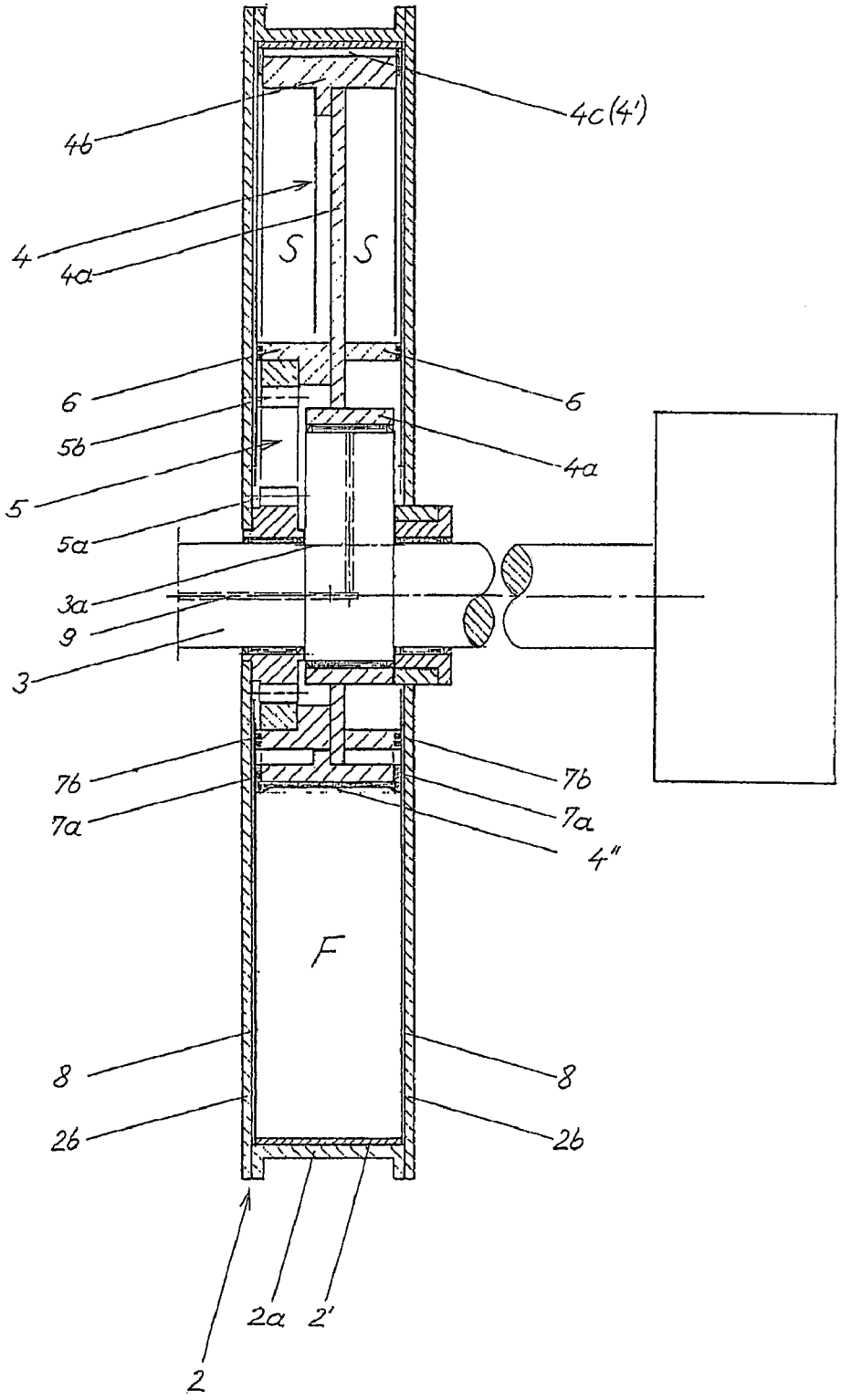
FIG. 2 shows a slurry pump in longitudinal section.

FIG. 2 shows a slurry pump according to FIG. 1 in longitudinal section. In the centre of the case 2 there is mounted in the end case walls 2*b* an eccentric shaft 3 with its eccentric 3*a*. It is driven by a motor. The rotor 4 is mounted on the eccentric 3*a* of the eccentric shaft 3. It is assembled from the hub, arranged in the centre of the rotor, for receiving the bearing 4*a*, a web 4*a* with a centrally arranged partition wall 6 and the likewise centrally arranged element 4*b*, fastened to the web by screw connections, with which the longitudinal outer walls of the rotor prism are formed.

The flushing chamber (S) is formed by the inner wall surfaces of the longitudinal outer walls of the rotor prism and the longitudinal outer wall surfaces of the partition wall in conjunction with the inner wall surfaces of the two end walls of the case. Elastic elements 7*a* are vulcanised onto the end faces and outer wall surfaces of the longitudinal outer walls of the rotor prism 4'. Sealing strips 4*c* are also arranged on the longitudinal edges of the rotor prism 4'. Sealing elements and guide elements 7*b* are inserted into the end faces of the partition wall in correspondingly worked-in grooves.

The partition wall 6 is used here to receive and fasten the hollow toothed wheel 5*b*, which is also centrally arranged in the rotor 4 and engages in the pinion 5*a* arranged on the rotational axis of the eccentric shaft 3 and fastened to the end case wall 2*b*. A bearing for the eccentric shaft 3 is arranged in the hub of the pinion 5*a* secured to the case.

The case 2 is assembled from a longitudinal side wall 2*a* and two end walls 2*b*. The end walls 2*b* are screwed to the longitudinal wall 2*a* by a flanged connection. The inner wall surface of the longitudinal housing wall 2*a* is equipped with a particularly hard and wear-resistant lining here, on the surface of which the end surfaces of the sealing strips 4*c*, arranged on the longitudinal edges of the rotor prism, slide. The lining is fastened so as to be replaceable. Wear plates 8 with a hard surface and good surface quality are replaceably provided on the inner sides of the end housing walls 2*b*. They are used as counter running surfaces for the end sealing elements and guide elements 7*a*, 7*b* on the rotor 4.

Figure 3:
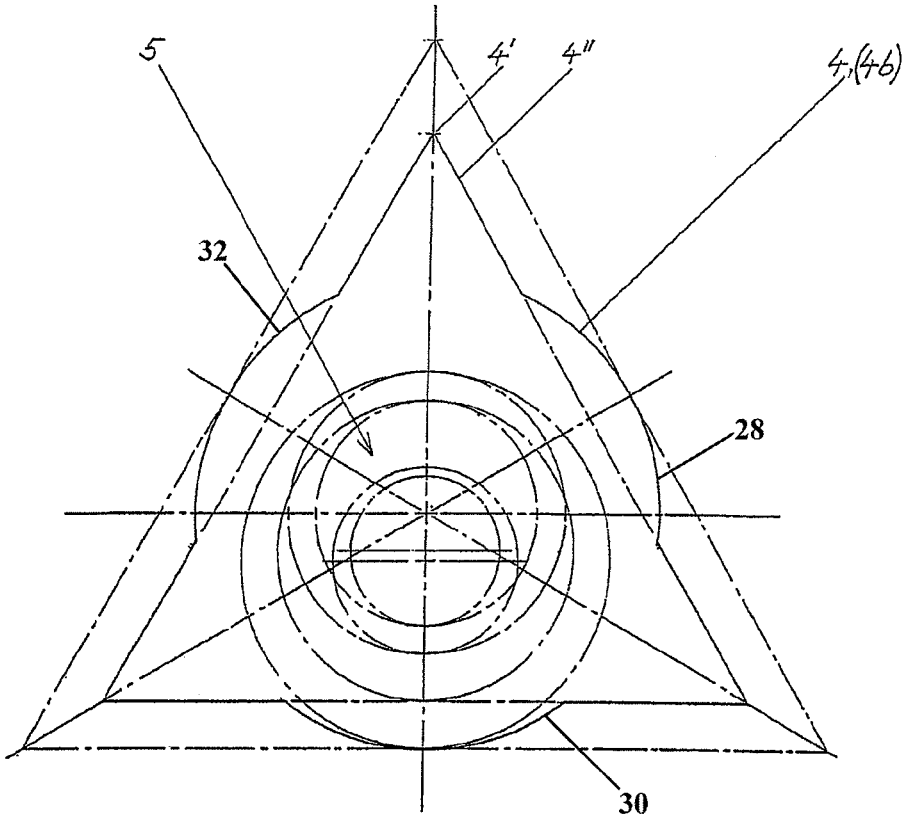
FIG. 3 shows a particular embodiment of the rotor in cross-section.

FIG. 3 shows the contour of the longitudinal outer walls of a triangular rotor prism for a preferred embodiment of the rotor 4. The advantage of longitudinal outer walls formed with bulges 28, 30, 32 of this type in a triangular rotor prism lies in the enlargement of the space for the gearing 5 enclosed therein while simultaneously reducing the spatial fraction in the delivery chambers that is ineffective for the delivery volume.

Figure 4:
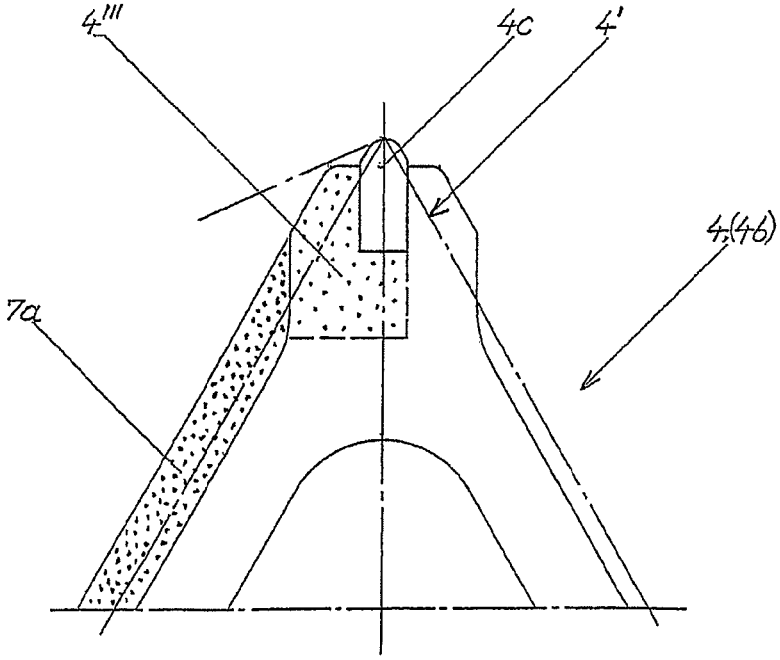
FIG. 4 shows a detail illustration of the corner region of a rotor in cross-section.

FIG. 4 shows in a detail illustration a possible embodiment for the corner region in the case of a triangular rotor prism. The sealing strip 4*c* is held in this case in a groove worked into the longitudinal edge of the rotor prism 4'. Shown in cross-section at one side is one of the alternately worked-in recesses 4''' filled with elastic material and one of the elastic elements 7*a* vulcanised onto the longitudinal outer walls of the rotor prism 4'.

Figure 5:
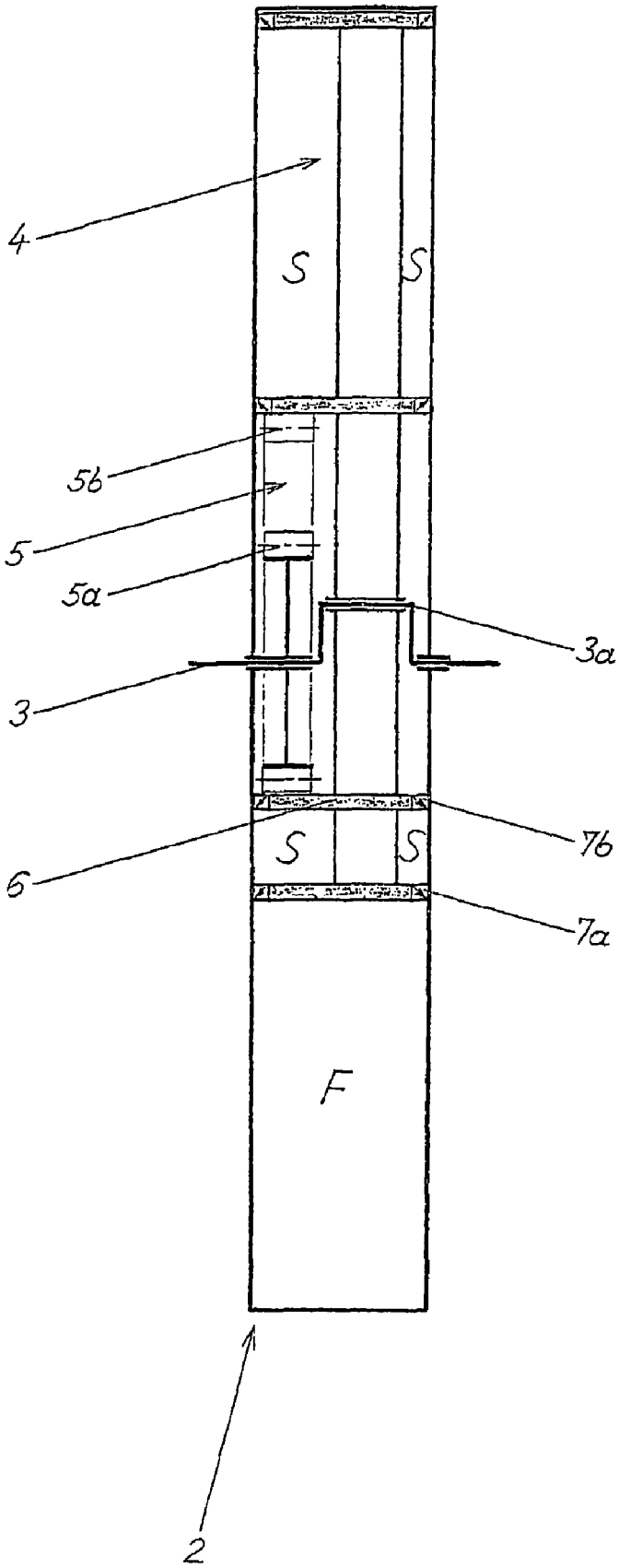
FIG. 5 shows a schematic view of a gearing according to FIG. 1 (longitudinal section)

FIG. 5 schematically shows in longitudinal section a pump according to FIG. 1 with a gearing 5. The schematic drawing contains all main components of the pump, such as the case 2, the eccentric shaft 3, the rotor 4 and in particular the elements of the gearing 5. It may be seen that the case-secured pinion 5*a* arranged on the axis of the eccentric shaft 3 in the centre of the case 5 meshes with the rotor-secured hollow toothed wheel 5*b* arranged on the centre axis of the eccentric 3*a* or rotor 4 mounted on the eccentric 3*a* (as also shown in FIG. 2).

Figure 6:
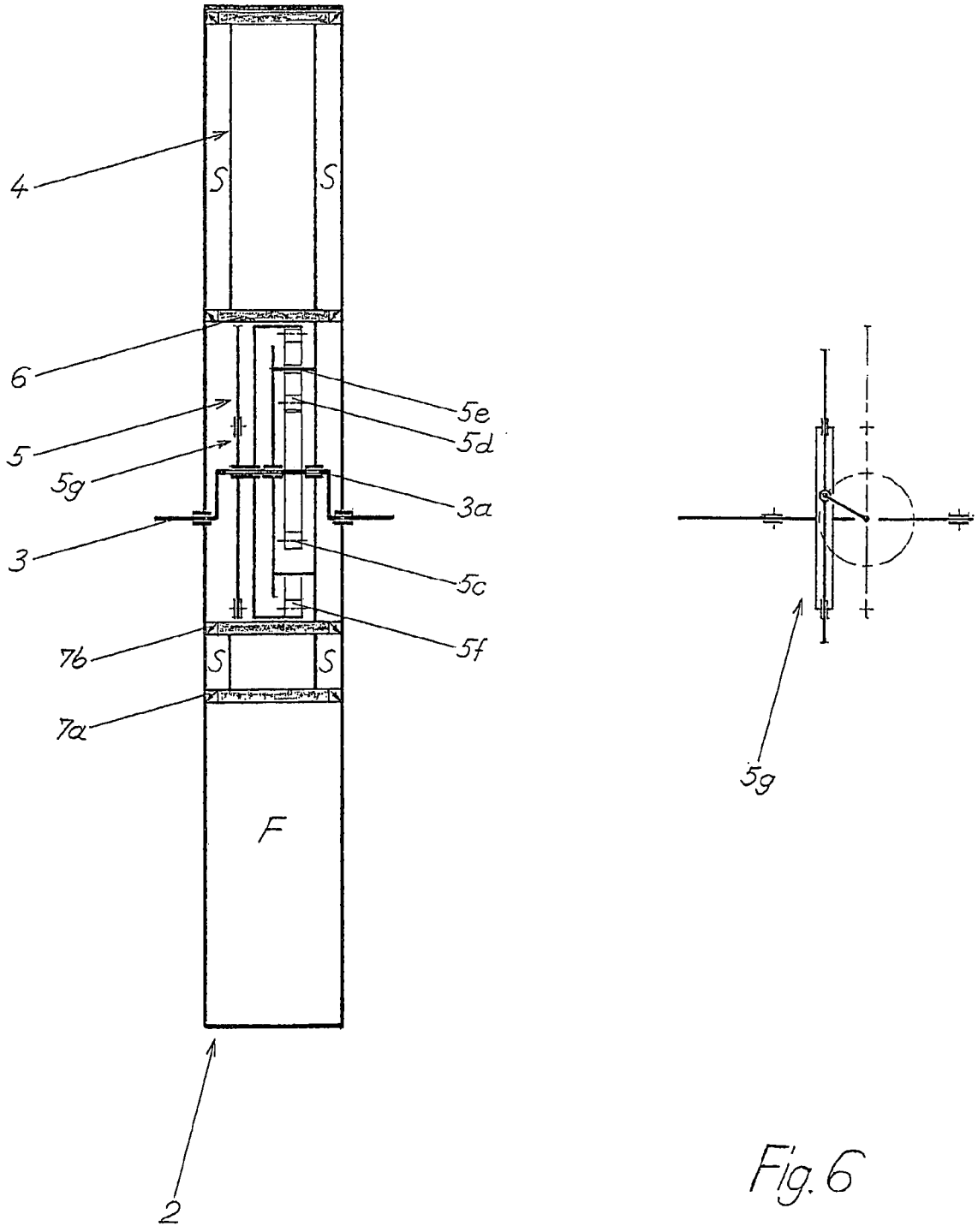
FIG. 6 shows a schematic view of a gearing according to FIG. 1 (longitudinal section, plan view of the cross coupler).

FIG. 6 shows a pump according to FIG. 1 with a gearing in longitudinal section and schematically partially in a plan view. The schematic drawing, like FIG. 5, contains all main components of the pump 1 and in particular the elements of the gearing 5. The planetary gear arranged on the centre axis of the eccentric 3*a* or the rotor 4 mounted on the eccentric 3*a* may be seen. The sun wheel 5*c* is fastened to the eccentric 3*a* of the eccentric shaft 3 so as to be secured against rotation. The planetary wheels 5*d* are mounted on the rotor-secured planet carrier 5*e* so as to be rotation-free. The internal gear 5*f* is mounted on the eccentric 3*a* of the eccentric shaft 3 so as to be rotation-free and is connected by its hub to the guide bar of a cross coupler 5*g*. This connection means that it cannot rotate about the centre axis of the eccentric 3*a* and is supported on the case 2 by way of the cross coupler 5*g*. The cross coupler 5*g* is also schematically shown separately in the right-hand half of FIG. 6 in a plan view.

The invention claimed is:

1. Pump, in particular a slurry pump, comprising a rotor driven so as to rotate in a case, wherein the rotor is constructed as a polygonal prismatic body in which at least the connecting lines of the corners of the base surfaces form an equilateral polygon, and which performs a rotational movement about an orbiting centre axis, with the prismatic body having longitudinal edges touching a longitudinal inner wall surface of the case, wherein the longitudinal wall of the case includes at least one supply opening for supplying the material to be conveyed and one discharge opening for discharging the material to be conveyed, the supply opening having a start and an end, the discharge opening having a start and an end, wherein, with the rotor in a first position, the end of the supply opening and the start of the discharge opening are offset from one another by an angle equal to the central angle of the equilateral polygon in relation to the centre axis of the rotor, and wherein, with the rotor in a second position, the end of the discharge opening and the start of the supply opening are offset from one another by an angle equal to the central angle of the equilateral polygon in relation to the centre axis of the rotor.

2. Pump according to claim 1, wherein the rotor is mounted on an eccentric of an eccentric shaft so as to be rotation-free, in particular also longitudinal axis-free such that a centre line of the eccentric coincides with the centre axis of the rotor and when the eccentric shaft revolves is rotated by a gearing about an angle which corresponds to the central angle of the equilateral polygon.

3. Pump according to claim 2, wherein the gearing is formed by a rotor-secured hollow toothed wheel which is arranged on the centre axis of the rotor and a case-secured pinion arranged on a rotational axis of the eccentric shaft.

4. Pump according to claim 2, wherein the gearing is formed by a planetary gearing arranged on the centre axis of the rotor, and of which a sun wheel is fastened to the eccentric of the eccentric shaft so as to be rotation-free, of which the planetary gearing are mounted on a rotor-secured planet carrier so as to be rotation-free, of which an internal gear is mounted on the eccentric of the eccentric shaft so as to be rotation-free and is supported by a cross coupler on an end wall of the case so as to be secured against rotation.

5. Pump according to claim 2, wherein in the rotor, preferably on the centre axis thereof, there is arranged a partition wall which radially surrounds the gearing and extends to the inner wall surfaces of two end walls of the case.

6. Pump according to claim 5, wherein provided on the rotor at the end faces of the partition wall are sealing elements and in particular also guide elements which touch the inner wall surfaces of the two end walls of the case.

7. Pump according to claim 2, wherein bearings and gear teeth as well as sealing and guide elements are fed by a central lubricating unit with conduits leading through the eccentric shaft and the rotor.

8. Pump according to claim 1, wherein a plurality of pump units are arranged parallel and side-by-side and, coupled to each other by their eccentric shafts, are driven by one or more drive(s) via the free ends of the eccentric shafts.

9. Pump according to claim 1, wherein two pump units are driven by a drive arranged between the two pump units, via the eccentric shafts.

10. Pump according to claim 1, wherein provided on the rotor, on the end faces of the outer walls forming the longitudinal outer wall surfaces of the prismatic body, are elastic, wear-resistant elements which touch inner wall surfaces of two end walls of the case.

11. Pump according to claim 10, wherein the elastic, wear-resistant elements provided on the end faces of the outer walls of the rotor forming the longitudinal outer wall surfaces of the prismatic body are vulcanised or glued on and extend beyond the end faces of the outer walls even on the longitudinal outer wall surfaces of the outer walls.

12. Pump according to claim 1, wherein sealing strips are arranged on the rotor on the longitudinal edges of the prismatic body.

13. Pump according to claim 12, wherein the sealing strips on the longitudinal edges of the prismatic body are replaceable and are made from a highly wear-resistant, hard material.

14. Pump according to claim 12, wherein the sealing strips are received and held in a groove worked into the longitudinal edges of the prismatic body.

15. Pump according to claim 14, wherein alternating recesses are also worked into the longitudinal edges of the prismatic body and are filled with vulcanised-on or glued-on, elastic, wear-resistant material.

16. Pump according to claim 1, wherein the inner wall surface of the longitudinal wall of the case is wear-resistant and/or is equipped with a wear-resistant coating.

17. Pump according to claim 1, wherein the case is formed by a longitudinal wall and two end walls releasably connected thereto.

18. Pump according to claim 7, wherein at the eccentric shaft the diameter of an eccentric of the eccentric shaft is at least as large as the largest shaft diameter enlarged by twice the amount for an eccentricity of the eccentric shaft.

19. Pump according to claim 1, wherein the rotor is constructed as a prismatic body, in which at least the connecting lines of the corners of the base surfaces form an equilateral triangle.

20. Pump according to claim 19, wherein the longitudinal outer walls of the prismatic body have arc of a circle-shaped bulges in their middle region.

* * * * *